US007208864B2

(12) United States Patent
Roquais et al.

(10) Patent No.: US 7,208,864 B2
(45) Date of Patent: Apr. 24, 2007

(54) OXIDE CATHODE FOR ELECTRON GUN WITH A DIFFERENTIALLY DOPED METALLIC SUBSTRATE

(75) Inventors: Jean-Michel Roquais, Dijon (FR); Donald John Wierschke, Lancaster (FR)

(73) Assignee: Thomson Licensing, Boulogne-Billancourt (FR)

( * ) Notice: Subject to any disclaimer, the term of this patent is extended or adjusted under 35 U.S.C. 154(b) by 22 days.

(21) Appl. No.: 10/522,115

(22) PCT Filed: Jul. 21, 2003

(86) PCT No.: PCT/EP03/50323

§ 371 (c)(1),
(2), (4) Date: Sep. 28, 2005

(87) PCT Pub. No.: WO2004/012217

PCT Pub. Date: Feb. 5, 2004

(65) Prior Publication Data

US 2006/0158086 A1 Jul. 20, 2006

(30) Foreign Application Priority Data

Jul. 24, 2002 (EP) ..... 02291859

(51) Int. Cl.
*H01J 1/14* (2006.01)

(52) U.S. Cl. ..... 313/346 R; 313/346 DC

(58) Field of Classification Search ..... 313/446, 313/270, 346 R, 346 DC
See application file for complete search history.

(56) References Cited

U.S. PATENT DOCUMENTS 3,535,757 A 10/1970 Nestleroth et al.
3,911,312 A 10/1975 Coenen et al.
4,215,180 A 7/1980 Misumi et al.

FOREIGN PATENT DOCUMENTS

EP 1152447 11/2001

OTHER PUBLICATIONS

Search Report Dated Dec. 1, 2003.

*Primary Examiner*—Vip Patel
(74) *Attorney, Agent, or Firm*—Joseph J. Laks; Harvey D. Fried; Richard LaPeruta

(57) ABSTRACT

The metallic substrate of this cathode has a thickness ≦100 μm and contains a plurality of reducing agents as Si or Al and on the top face 111, 0.005%<Mg≦0.1%, Si or Al≦0.025%, and W≦3%, on the bottom face 122, Mg weight concentration is inferior to the Mg weight concentration on the top face, and Si or Al weight concentration is superior to Si or Al weight concentration on the top face and superior to 0.02%. Lifetime is maximized and turn-on-time is minimized.

15 Claims, 5 Drawing Sheets

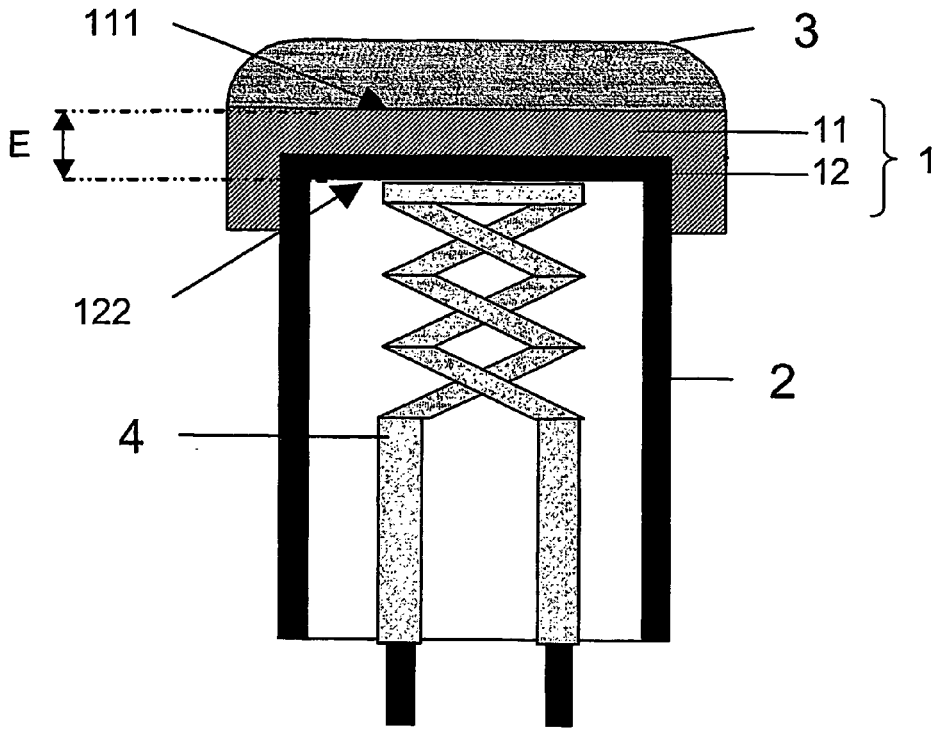
Fig.3
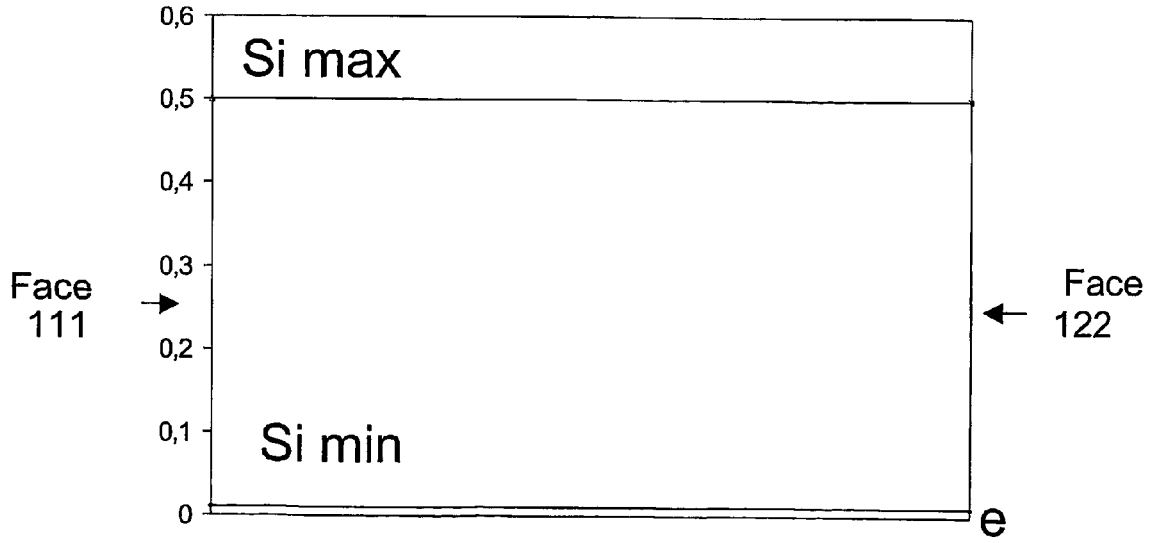
Fig.4 – PRIOR ART

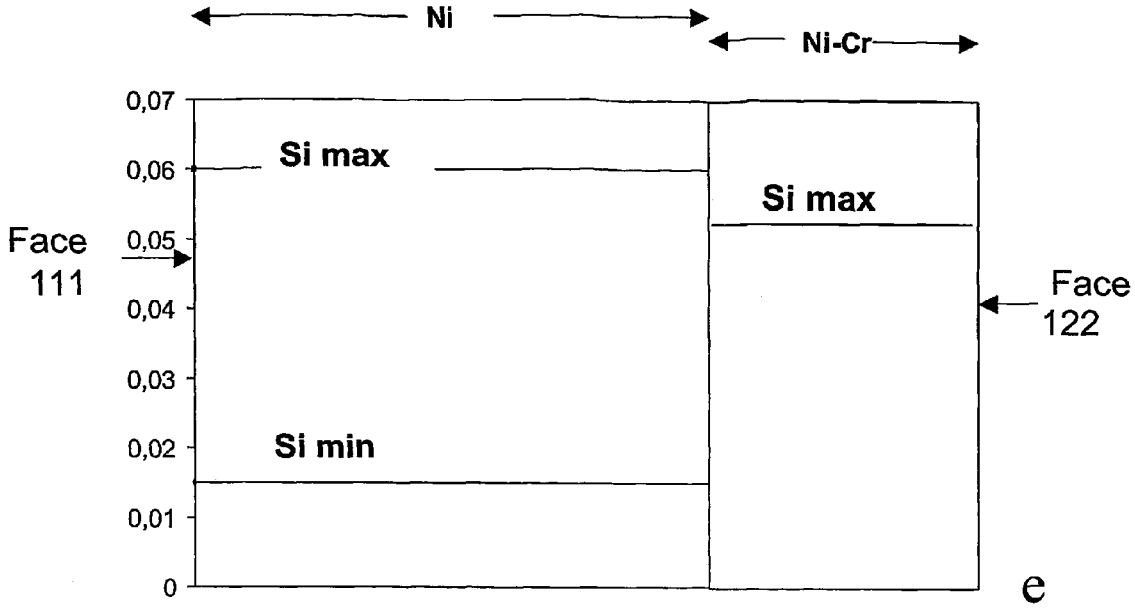
Fig.5 – PRIOR ART
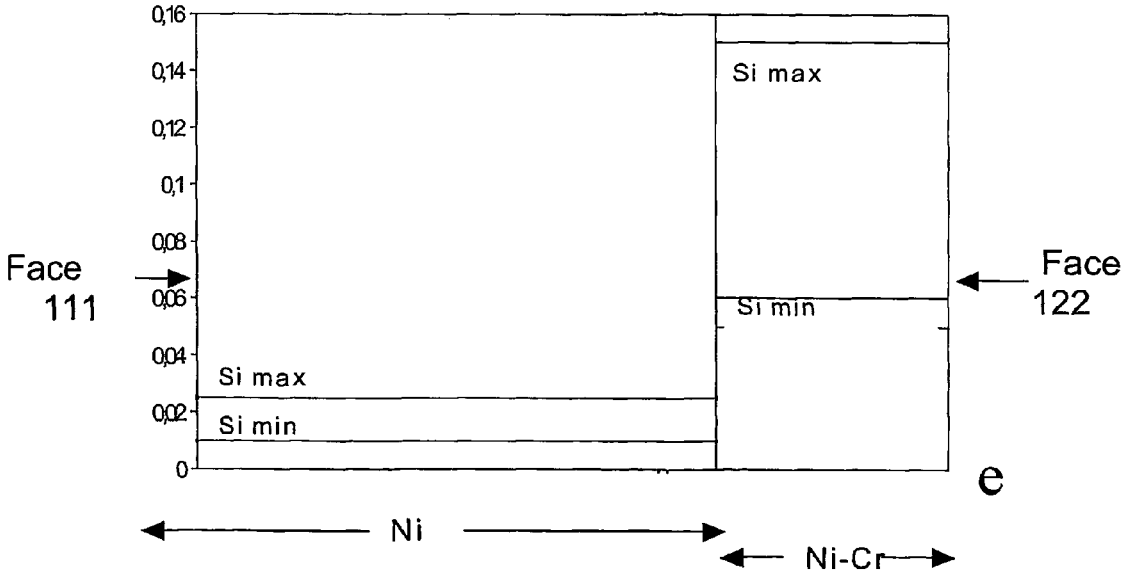
Fig.6

OXIDE CATHODE FOR ELECTRON GUN WITH A DIFFERENTIALLY DOPED METALLIC SUBSTRATE

This application claims the benefit, under 35 U.S.C. § 365 of International Application PCT/EP03/50323, filed Jul. 21, 2003, which was published in accordance with PCT Article 21(2) on Feb. 5, 2004 in English and which claims the benefit of European patent application No. 02291859.3, filed Jul. 24, 2002.

1/ FIELD OF THE INVENTION

The present invention concerns the oxide cathodes that are commonly used, as an electron source, in electron guns for cathode ray-tubes. The electrons are emitted from the cathode thanks to a thermoionic effect. Cathode ray-tubes are mainly used as display device for computers or television.

2/ BACKGROUND OF THE INVENTION

Referring to FIG. 1, a conventional oxide cathode comprises

- a cathodo-emissive layer 3 basically made of alkaline earth oxides or a mixture of such oxides.
- a substrate 1 onto which the cathodo-emissive layer 3 is deposited, which is generally made of a nickel alloy, containing one or several reducing agents as Mg, Al, Si, W, Cr and/or Zr. Nickel alloy of the substrate 1 is generally based on a mixture of nickel and tungsten or a mixture of nickel and molybdenum.

The conventional oxide cathode shown on FIG. 1 comprises more precisely a cup-liked shape nickel alloy monolayer substrate 1, a tube-liked shape sleeve 2 made of an alloy containing at least Ni and Cr, onto which the metallic substrate 1 is welded. As two metallic parts are used to constitute the cathode, namely a metallic substrate 1 and a sleeve 2, this type of cathode is called a "two-piece cathode". A cathodo-emissive layer 3 of double or triple carbonates, i.e. a mixture of (Ba, Sr) $CO_3$ or (Ba, Sr, Ca) $CO_3$ is deposited onto the substrate 1. Those carbonates, which are chemically stable under air exposure, are decomposed into double oxides BaO, SrO or triple oxides BaO, SrO, CaO by heating the cathode under vacuum during the activating sequence of a cathode-ray tube. Subsequently, metallic barium is created in the double or triple oxide cathodo-emissive layer 3 at the operating temperature of the cathode, which lies preferably in a range of 700° C. to 850° C., the presence of metallic barium being mainly responsible for the good emission properties of the double or triple oxide cathodo-emissive layer 3 of the cathode. For this point on, for convenience, references to triple oxide will be understood to include double oxide as well. The cathode is heated to its operating temperature by thermal radiation of a heater 4 inserted inside the sleeve 2; this heater 4 is generally made of a tungsten wire or an alloy of W and Re, generally covered by a layer of aluminum oxide.

As an alternate to the conventional cathode described in FIG. 1 having a nickel monolayer as a metallic substrate 1, a double layer of nickel alloys is also commonly used as a metallic substrate (see for example U.S. Pat. No. 3,919,751, G.T.E Sylvania Inc.). This double layer is commonly referred to as a bimetal. A cathode using a bimetal for a metallic substrate 1 is shown in FIG. 2. The double layer comprises a top layer 11 of nickel or an alloy of nickel containing 1 to 5% tungsten or alternatively 1 to 5% molybdenum (in weight percent) bonded to a bottom layer 12 of alloy of nickel and chromium (typically an alloy called "nichrome", containing 20% Cr, the remainder being essentially Ni). The double layer substrate 1 comprising nickel top layer 11 and nickel-chromium bottom layer 12 can be formed into a cup which is welded onto a nickel-chromium sleeve 2, as described on FIG. 2. In this case, as a cup-shaped substrate 1 is welded to a sleeve 2, this cathode is also called a "two-piece cathode", as the other conventional cathode described on FIG. 1. A usual cathodo-emissive layer 3 is made of triple carbonates, i.e. a mixture of (Ba, Sr, Ca) $CO_3$, that is deposited onto the top layer 11. The deposited layer is heated to its operating temperature by thermal radiation of a heater 4 inserted into the sleeve 2 as in FIG. 1.

It is known, alternatively, to make a "one-piece cathode" using a bimetal, as described on FIG. 3. In this case, a bimetal strip which comprises a top layer 11 and a bottom layer 12 as previously described in reference to FIG. 2, is formed into a tube which is closed at one end, with the nickel-based top layer 11 appearing as the outside face of the tube. By selectively etching away the nickel-based top layer 11 and by protecting the closed end of the tube, it is possible to remove all the nickel-based top layer 11 except on the top-portion or closed end of the tube, thus leaving a double layer cap-shaped substrate 1 of a desired height on a nichrome sleeve 2 (See for example U.S. Pat. No. 4,849,066, R.C.A). This cathode, although obtained through a different process, is very similar to the previous cathode described in reference to FIG. 2. This cathode being constituted of only one part, is called a "one-piece cathode".

In the oxide cathode, for both cases where the substrate 1 is made of a single layer or of a double layer, the creation of the metallic baryum is maintained through the cathode life by reduction of BaO into Ba caused by the chemical reaction of BaO with all elements contained in the nickel having a reducing power with respect to BaO. The chemical reduction occurs at the operating temperature of the cathode (typically 700° C.–850° C.) or at any step of the fabrication of the cathode ray tube where the cathode is heated, for instance the activation step designed to bring a cathode to its optimum emission capabilities. When the cathode is heated, the reducing elements contained in the substrate 1 thermally diffuse to the interface between the substrate 1 and the cathodo-emissive layer 3 where they react with BaO to liberate metallic Ba and form reaction compounds. Examples of chemical reactions between reducing elements and BaO are given below for Mg, Al, Si and W:

$$Mg+BaO \rightarrow MgO+Ba$$

$$2\ Al+4\ BaO \rightarrow BaAl_2O_4+3\ Ba$$

$$Si+4\ BaO \rightarrow Ba_2SiO_4+2\ Ba$$

$$W+6\ BaO \rightarrow Ba_3WO_6+3\ Ba$$

Metallic barium, at the operating temperature of the cathode, constantly evaporates from the cathodo-emissive layer 3. To maintain good emission properties, this loss of barium must be compensated by the creation of metallic barium through chemical reactions as described above. The flux of reducing elements that react with BaO must not go below the minimum level necessary to create the amount of metallic barium needed for good emission properties to be sustained. The reducing elements come to the interface between the double-layer substrate 1 and the cathodo-emissive layer 3 by diffusion from the top layer 11 of the substrate. As the reducing elements contained in the bottom layer 12 (for example chrome, or Si if the "nichrome" of this bottom layer is Si doped) migrate from the bottom layer 12 into the top layer 11, as these reducing elements can also diffuse further to the interface between the top layer 11 and the cathodo-emissive layer 3 to play a positive role for cathode life, they act in fact as an additional reserve of reducing elements. On FIG. 9, the increase of silicon concentration in the top layer 11, measured by the ICP method (Inductively Coupled Plasma) as a function of operation time of such various cathodes is displayed. The initial concentration of silicon is the concentration on the metal of the top layer 11, as set at the elaboration of this metal. The enrichment of the top layer in silicon with time is attributed to the diffusion of the silicon from the bottom layer 12 to the top layer 11. In this series of bimetal samples, the average concentration of silicon in the nichrome bottom layer is 0.18%. The difference between this value of concentration in the bottom layer and the value in the nickel top layer is the driving force for the diffusion of Si from the bottom to the top layer.

It is of common usage to use either Mg or Zr as a fast activator acting at the beginning of cathode life combined with Si or Al as a long-term activator to extend cathode life when the fast activator is no longer acting. Two main factors are known to limit the flux of reducing elements to the interface between the top layer 11 and the cathodo-emissive layer 3. Firstly, as the reducing elements are consumed in the reaction with BaO, their concentration in the top layer 11 tends to decrease with life, and accordingly, their flux to this interface decreases. Complete exhaustion of the reducing elements can even occur if their initial concentration in the top layer 11 is low. Another factor limiting the flux of reducing elements is the build-up of the reaction compounds at this interface between the top layer 11 and the cathodo-emissive layer 3, forming thus a blocking layer for diffusing species (See for example: E. S. Rittner, Philips Res. Rep., T.8, p 184, 1953). First of all, this blocking layer starts to be created at the annealing steps performed on the substrate 1 prior to deposition of the cathodo-emissive layer 3. During this annealing step, the reducing elements are oxidized by minute amounts of oxygen resulting in the creation of MgO, $SiO_2$ or $Al_2O_3$. The oxygen comes from the decomposition of the water vapor added in the atmosphere of the furnace used for annealing, usually composed of excess hydrogen. Then, this blocking layer is further built up during cathode operations. The interfacial compounds that mainly build-up during life are the W-based compounds and the Si-based compounds.

To overcome the exhaustion of the reducing agents, one could think of increasing the concentration of those latter in the top layer 11, but this has the disadvantage of increasing the rate of formation of the detrimental compounds that build-up the blocking layer. In addition to the disadvantage of limiting the flux of reducing elements, the interfacial compounds of this blocking layer tend to worsen the adhesion of the cathodo-emissive layer 3 on the top layer 11. This is in itself a sufficient reason to maintain the development of those compounds as low as possible. As a possible solution to avoid both the exhaustion of the reducing agents and the fast build-up of a blocking layer in the early stage of cathode life, it could be proposed to have a reasonably low concentration of reducing elements in the top layer 11, but a thickness of the substrate 1 high enough to provide a good reserve of reducing elements (See for example: H. E. Kern, Bell Laboratories Record, T. 38, n° 12, p 451, December 1960). For instance, in a first approximation, one could consider about composition of the top layer 11 that a 400 μm thick nickel doped with 0.01% by weight of Si is equivalent, in terms of Si reserve, to 100 μm with 0.04% by weight of Si, the product of weight concentration by the thickness being the same. In fact, another important characteristic, i.e. the thickness E of the substrate 1, has to be taken into account for the design of the cathodes for cathode ray tubes, such as display tubes for computers or television. The electron-beam turn-on time is directly linked to the time needed for the cathode to reach its operating temperature. This time increases with the cathode weight so it is of importance to have the substrate 1 with the lowest possible weight. The lowest thickness commonly used for cathode metallic substrate 1 is about 70–100 μm, but such a low thickness forbids the use of low concentrations of reducing elements in this substrate, because firstly, at least 1% of W and/or Mo in weight in the nickel used for the substrate is necessary to maintain a good mechanical strength of the substrate and secondly, the concentration of the active reducing elements like Mg or Si cannot be set at low levels around 0.01% in weight because the reserve of reducing elements would be too low. If the thickness of the substrate is increased in a range of 150 to 200 μm, far lower concentration of W and/or Mo can be used for the substrate based on nickel, but the turn-on-time is degraded in comparison with a substrate thickness of 70 μm. Thus, it seems that there is no way to combine both the low concentration of reducing elements leading to a slow rate of formation of detrimental compounds and of a blocking layer, and the low substrate thickness leading to the low turn-on time. This could be done only at the expense of cathode lifetime, a case that is not acceptable. The present invention offers the possibility of both a minimized turn-on-time and a long lifetime.

Another important aspect of the optimization of the substrate chemistry is the fact that some of the reducing elements have a relatively high vapor pressure that leads to significant evaporation into the vacuum of the cathode ray-tube, when the cathode is heated. Comprised in this family of high vapor pressure elements is Mg. The Mg metallic vapor tends to condense on the different parts of the electron gun of the cathode ray-tube. For all types of cup-liked shape metallic substrate, one can define top face 111 as the surface on which the cathodo-emissive layer 3 is deposited and bottom face 122 as the surface of the substrate which is opposite to top face 111, as shown on FIG. 3. Bottom face 122 faces the heater 4 and several electrical metallic connectors of the electron gun which are not represented. The deposition of the metallic vapors of reducing elements coming from the cathode onto these electrical connectors create electrical leakages or shortcuts between electrodes of the gun detrimental to the good operation of the electron gun in the cathode-ray tube.

3/ SUMMARY OF THE INVENTION

It is an object of the invention to reach simultaneously:

- a lifetime as long as possible for the cathode,
- a minimized turn-on-time for the electronic tube in which the cathode will operate, with minimized deposits of any cathode materials onto other electrical parts inside this tube during operations.

For this purpose, the subject of the invention is an oxide cathode for an electron gun comprising

- a cathodo-emissive layer basically made of alkaline earth oxides or of a mixture of such oxides,
- a metallic substrate having a top face onto which the cathodo-emissive layer is deposited, and a bottom face opposite to said top face, containing a plurality of reducing agents which are able to reduce said oxides under conditions of operation of said electron gun, said plurality including a first reducing agent Mg and a second reducing agent Si or Al, characterized in that:

on the said top face, the Mg weight concentration is superior to 0.005%, the second reducing agent weight concentration is inferior or equal to 0.025%, and the refractory metals weight concentration is inferior or equal to 3%, where so-called refractory metals are selected from the group consisting of W, Mo, Re, on the said bottom face, the Mg weight concentration is inferior to the Mg weight concentration on the said top face, and the second reducing agent weight concentration is superior to the second reducing agent weight concentration on the said top face and superior to 0.02%, the thickness E of the said metallic substrate is inferior or equal to 100 μm.

The present invention brings simultaneously the following advantages;

globally, over the entire substrate of the oxide cathode, a large reserve of Mg and Si as reducing agents to provide a long lifetime with minimized thickness E of this substrate of at most 100 μm; thanks to the minimum Mg concentration, enough Mg at top face of the substrate is provided to sustain good cathode emission in early life, a low rate of formation of interfacial compounds and of blocking layer, thanks to the very low concentration of Si or Al and to the low concentration of W (≦3%) on the top face of this substrate and in its proximity, while having nonetheless a global large reserve of Si or Al on the bottom face as reducing agents to maintain long-term emission of the oxide cathode, an optimized turn-on time thanks to a substrate thickness less or equal to 100 μm.

Although it is possible to have Si and Al together as the so-called second reducing agent, it is preferred to have either Si alone, either Al alone to avoid adhesion problems of the cathodo-emissive layer on the substrate.

Preferably, to get enough reserve of Mg and of second reducing agent:

from the said top face up to a top depth of at least 20 μm into said substrate, the Mg weight concentration related to this top face is superior to 0.005%, the second reducing agent weight concentration related to this top face is inferior or equal to 0.025%, and the refractory metals weight concentration related to this top face is inferior or equal to 3%, from the said bottom face up to a bottom depth of at least 10 μm into said substrate, the Mg weight concentration related to this bottom face is inferior to the said Mg weight concentration related to the top face, and the second reducing agent weight concentration related to this bottom face is superior to the said second reducing agent weight concentration related to the top face and is superior to 0.02%.

Such weight concentration may be measured by any known analytical methods, preferably by ICP (Inductively Coupled Plasma) spectrometry.

Preferably, the Mg weight concentration related to the bottom face is inferior to 0.8×Mg weight concentration related to the top face.

Preferably, the second reducing agent weight concentration related to the bottom face is superior to 2× second reducing agent weight concentration related to the top face.

Preferably, the Mg weight concentration related to the top face is inferior or equal to 0.1% to lower detrimental evaporation of metallic vapor of Mg on the electrical connectors of the electron gun and to avoid metallurgical problems of workability of the metallic substrate; within the general range 0.005–0.1%, two distinct possible ranges of Mg concentration related to the top face are advantageous:

the Mg weight concentration related to the top face is inferior or equal to 0.02%, and, still better, inferior to 0.01%; this limitation minimizes detrimental evaporation of metallic vapor of Mg on the electrical connectors of the electron gun.

the Mg weight concentration related to the top face is superior or equal to 0.05%; this higher Mg concentration is advantageous for cathodes that have to withstand high DC load, as for CRT that have to display still images.

Preferably:

the second reducing agent weight concentration related to the top face is superior to 0.01%.

the refractory metals weight concentration related to the top face is inferior or equal to 0.008%, the Mg weight concentration related to the bottom face is inferior or equal to 0.004%.

the second reducing agent weight concentration related to the bottom face is superior to 0.05%, preferably to 0.06%.

the second reducing agent weight concentration related to the bottom face is inferior to 0.2%; for higher concentration, some adhesion problems would be encountered.

from the said bottom face up to a depth of at 15 μm into said substrate, the Cr weight concentration is superior or equal to 12%.

This bottom part of the substrate where the Cr weight concentration is superior or equal to 12% constitutes a bottom layer which gives advantageously the substrate enough mechanical strength, allowing the low concentration, i.e. inferior or equal to 0.008%, of refractory metals on the top face or from this face up to said top depth into the substrate.

According to a preferred embodiment, the said substrat comprises two superimposed bonded metallic layers: a top layer and a bottom layer.

Such two superimposed bonded metallic layers forms a so-called bimetal. The invention brings advantageously an optimized usage of a bimetal as a cathode metallic substrate. Taking the opportunity that a given doping element can be added in the two layers constituting the bimetal, for instance a nickel based top layer and a nichrome based bottom layer, at two different concentrations, it is proposed in the present invention to dope the two layers differently as far as the first reducing agent Mg and the second reducing agent Si and/or Al are concerned. It is proposed the low Mg doping level according to the invention in the top layer, preferably high enough so as to have enough Mg at top face initially to ensure good cathode emission properties in the early life, while having almost no Mg in the bottom layer to limit Mg evaporation towards electrical connectors facing bottom face and resulting metallic film causing electrical leakages between electrodes of the electron gun. It is proposed the low Si and/or Al doping level according to the invention in the top layer so as to limit the initial formation of detrimental interfacial compounds and of a blocking layer between the top face and the cathodo-emissive layer, and it is proposed the high Si and/or Al doping level according to the invention in the bottom layer, so as to get a high reserve of Si ensuring long-term cathode life despite the moderate Si and/or Al concentrations in the top layer.

This difference in doping of the two layers of the bimetal used as a substrate for the cathode according to the invention can be summarized as being a "differential doping", offering the advantages described above. This double layer substrate has:

one top layer (the one onto which the triple carbonates of the cathodo-emissive layer are deposited) having a low level of doping in reducing elements, and one bottom layer having a high doping level to serve as a reserve of reducing elements. As nichrome is preferred for the bottom layer, one benefits, in addition to the high reserve of Si, the reserve of Cr which migrates into the top layer and to the top surface at the interface with the cathodo-emissive layer. The creation of detrimental W-based compounds and of a blocking layer at this interface can be avoided by having W weight concentration inferior or equal to 0.008%, i.e. practically no tungsten, in the top layer of the bimetal.

Preferably, the said bottom layer is made of nichrome. Such a Ni—Cr alloy is well-known for electron gun parts; Cr weight concentration lies generally in the range 12% to 40%; the minimum thickness of such a bottom layer would be around 15 μm. As such a nichrome bottom layer ensures the stiffness of the substrate and brings good thermo-mechanical behavior to the cathode, it is possible to have a "no tungsten" top layer.

Said alkaline earth oxides are preferably selected from the group consisting of BaO, SrO and CaO or BaO, SrO. The mixture of alkaline earth metal oxides can be doped with other oxides such as $Sc_2O_3$, or $Y_2O_3$.

Said plurality of reducing agents may further include elements which are selected from the group consisting of Cr and Zr. Any other element with enough reducing power for reducing the alkaline earth metal oxides can also be used.

Such a cathode according to the invention may be a "one-piece" cathode or a "two-piece" cathode.

The subject of the invention is also an electron gun having, as electron source, a cathode according to the invention. The subject of the invention is also a cathode-ray tube including at least such an electron gun.

4/ BRIEF DESCRIPTION OF THE DRAWINGS

The invention will be more clearly understood on reading the description which follows, given by way of non-limiting example and with reference to the appended figures in which:

FIGS. 1 to 3, already mentioned, show ladder-shaped sustain electrode structures according to the prior art;

FIG. 3 shows a <<mono-piece>> double layer or bimetal cathode,

Figure 1:
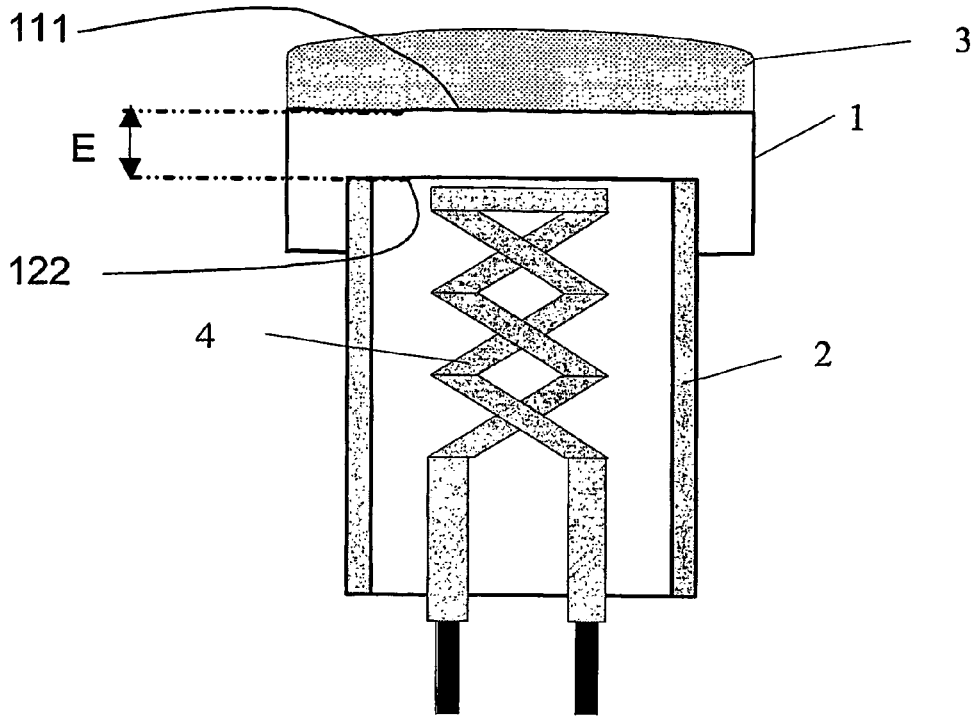
FIG. 1 shows a <<two-piece>> monolayer cathode.
Figure 2:
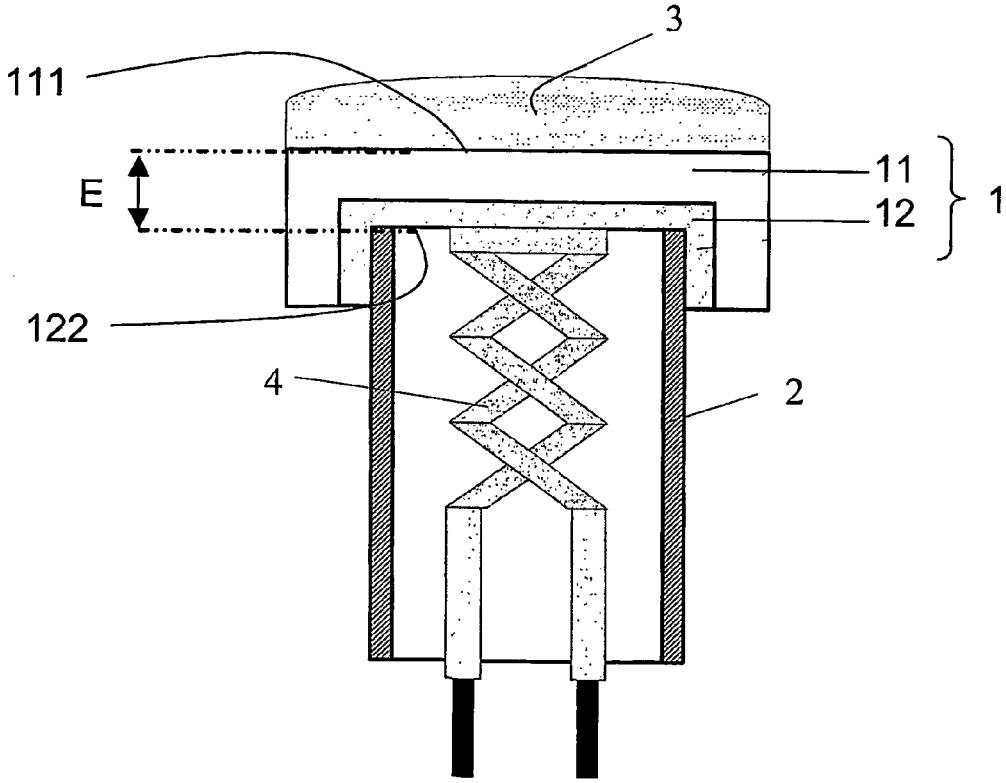
FIG. 2 shows a <<two-piece>> double layer or bimetal cathode.
Figure 7:
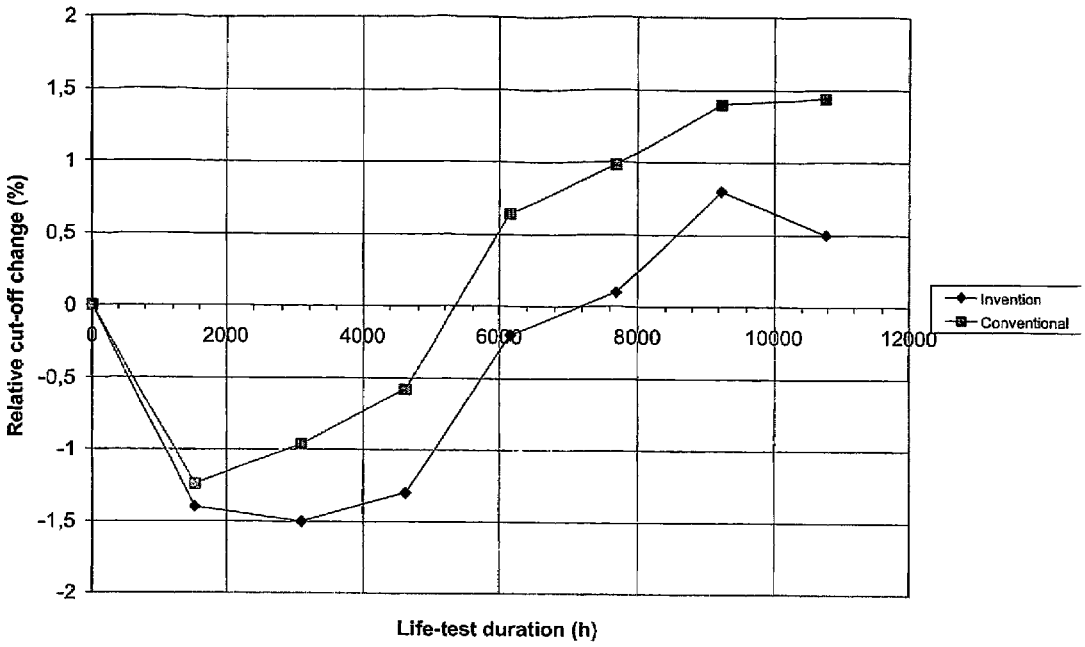

FIGS. 4 and 5 show Si concentration usual interval (weight %) according to prior art from top face up to bottom face respectively within a metallic substrate of a <<two-piece>> monolayer cathode according to FIG. 1, and within a metallic substrate of a <<two-piece>> or "one piece" bimetal cathode according to FIG. 2 or 3, FIG. 6 shows Si concentration interval (weight %) according to one embodiment of the invention from top face up to bottom face within a metallic substrate of a <<two-piece>> or "one piece" bimetal cathode, FIG. 7 shows the relative change of the cut-off voltage expressed in percentage (%), for cathodes using bimetal according to one embodiment of the invention (♦) and for cathodes using conventional bimetal (■).

Figure 8:
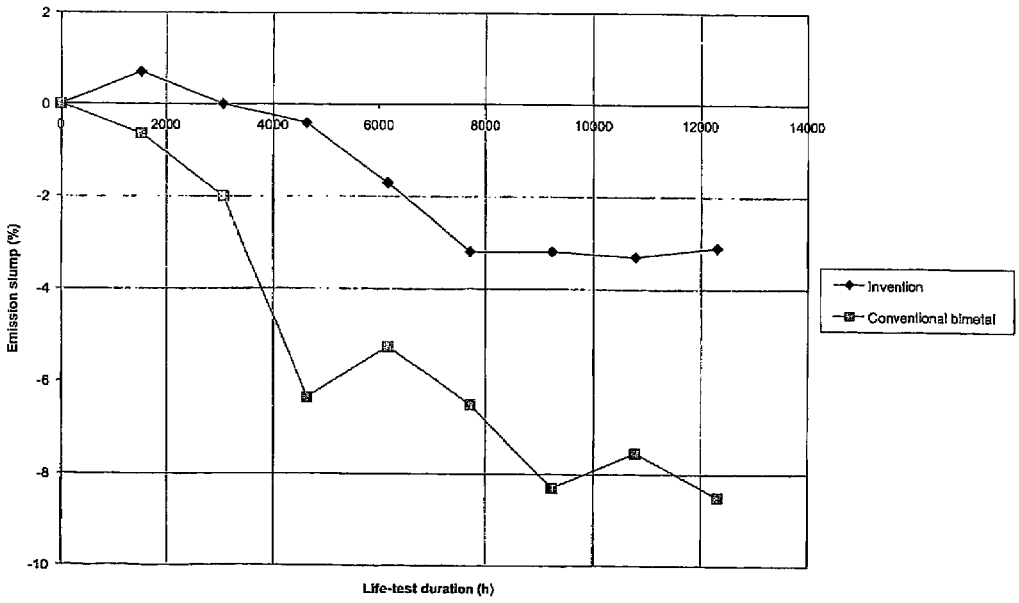

FIG. 8 shows the slump in cathodic emission expressed in percentage (%) of the initial emission, for cathodes using bimetal according to one embodiment of the invention and for cathodes using conventional bimetal.

Figure 9:
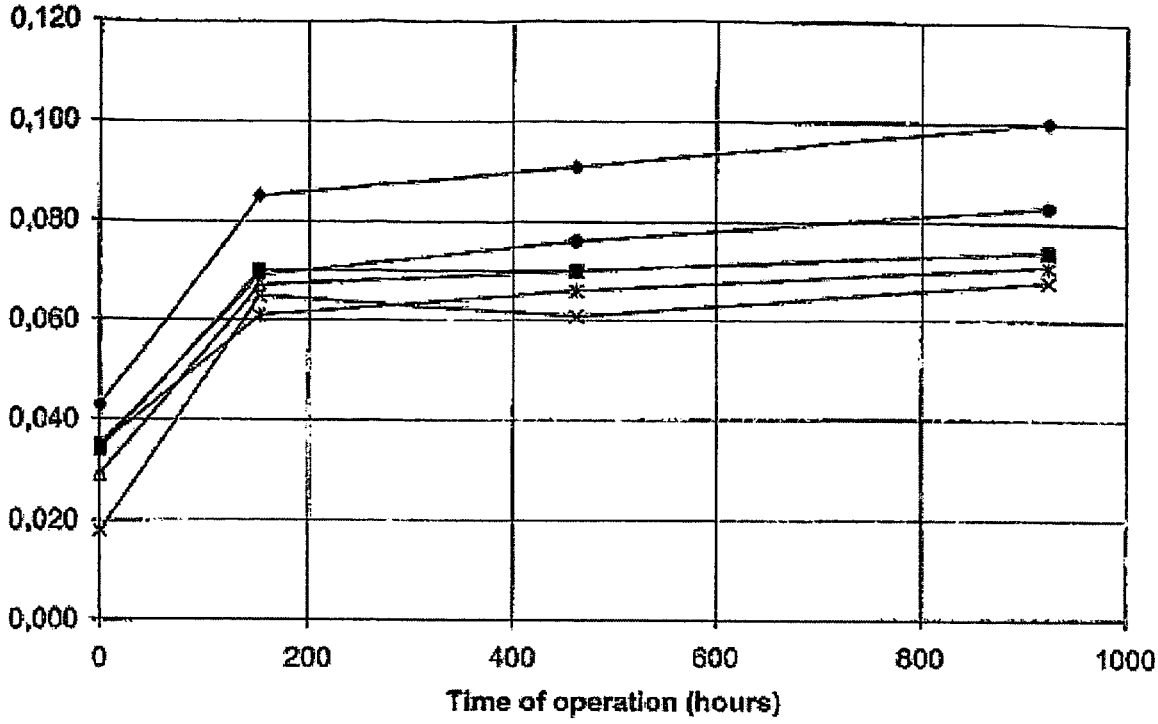

FIG. 9 shows the increase of silicon concentration on the top face of the metallic substrate of various oxide cathodes as a function of operation time of this cathode.

To simplify the description and demonstrate the differences and advantages that the invention has over the prior art, identical references will be used for the elements which provide the same functions.

5/ DESCRIPTION OF THE PREFERRED EMBODIMENTS

The invention will be now described using a bimetal for the substrate 1 of a one-piece cathode shown on FIG. 3, the main components of which have already been described. As any bimetal, this bimetal comprises two superimposed bonded layers, a top layer 11 with a top face 111 in contact with the cathodo-emissive layer 3, and a bottom layer having its external bottom face 122 facing the heater 4 inside the sleeve 2.

The top layer is mainly composed of nickel; its thickness is about 60 μm.

The bottom layer is mainly composed of a nickel alloy having 20% of chromium, called nichrome; its thickness is about 30 μm.

The substrate 1 according to the invention is made of 70–100 μm thick bimetal; even if W concentration in the Ni-based top layer is inferior or equal to 0.008%, it was proven that mechanical behavior is satisfactory. For comparison, the conventional substrates which use a single layer un-allied nickel (e-g without W or Mo added) have necessarily a minimum thickness between 150 and 200 μm to ensure stiffness, which gives a penalty for turn-on-time, as compared to 70–100 μm thick substrate.

The chosen concentrations of elements of interest in substrates according to the invention are summarized as well as for conventional substrates in table 1. From left to right, table 1 gives the range of concentration for W, Mg and Si of the top layer 11 (or on the top face 111 for a monolayer cathode), the range of concentration for Mg and Si of the bottom layer 12 (or on the bottom face 122 for a monolayer cathode), the range of the substrate thickness, and comments. From top to bottom, table 1 shows these ranges for conventional substrates (4 first lines) and for bimetal substrates according to the invention.

Embodiments 1, 2 and 3 of the invention concern substrates having a top face with "no tungsten"; embodiments 1 and 2 concern substrates having a top face within low range of Mg concentration; on the opposite, embodiments 3 and 4 concern substrates having a top face within high range of Mg concentration, particularly well adapted for cathodes that have to withstand high DC load.

The doping of substrate by Si is now given to illustrate the principle of differential doping on which the invention is based. On FIG. 4, the doping with Si of the conventional single layer substrate to be used in conventional two-piece cathode is shown. On FIG. 5, the doping of the conventional bimetal is shown. In this latter case, the top layer is doped with silicon in a preferred range, and the nichrome layer is not doped with silicon, which means that its concentration is inferior to silicon concentration in the top layer, and inferior or equal to 0.02%. Lowest Si concentration that can be detected using conventional analysis method is around 0.003%. On FIG. 6, the differential doping of the bimetal base substrate is illustrated according to the invention. Both the top layer and the bottom layer are doped with silicon. As the preferred range of concentration of Si in the top layer has a maximum that is inferior to the minimum of the range of Si concentrations in the bottom layer, all possible combinations of Si doping levels in top layer and bottom layer can be referred to as "differential doping". This differential doping with the same ranges can be also proposed with Al as a reducing element instead of Si.

FIGS. 7 and 8 show the typical performance in life-test of cathodes using bimetal of the invention compared to cathodes using conventional bimetal, both type of cathodes being operated at the same temperature in cathode ray tubes. The operating conditions for the cathodes are typical of TV receiver operation.

The bimetals that have been used for these life-tests have the following characteristics:

conventional bimetal:

top layer: thickness=60 μm; W=4%; 0.03%<Si<0.055%; 0.03%<Mg<0.06%, bottom layer: thickness=30 μm; Si<0.01%; Mg=0.01%.

bimetal according to the invention:

top layer: thickness=60 μm; W<0.008%; Si=0.015%; Mg=0.006%, bottom layer: thickness=30 μm; 0.06%<Si<0.2%; Mg=0.003%.

In FIG. 8, the slump in cathodic emission expressed in percentage (%) of the initial emission has been plotted against time of operation in hours. The cathodes according to the invention (♦) show a clearly lower emission slump than conventional cathodes (■), offering the advantage of maintaining over a longer period of time an optimum brightness of the TV picture.

FIG. 7 shows the relative change of the cut-off voltage, which depends on the change in distance between cathode and first electrode linked to thermal behavior of the system. Relative change of the cut-off voltage is very similar for cathodes of the invention (♦) and conventional cathodes (■). This proves that the mechanical behavior of the cathode according to the invention is as satisfactory as the one from conventional cathodes.

The detrimental compounds formed at the surface of conventional bimetal after the step of typical metal annealing, performed prior to carbonate coating deposition, have been evidenced on an SEM (Scanning Electron Microscope); using the same conditions, the surface of bimetal according to the invention has appeared free of detrimental compounds after the typical annealing step.

The bimetal with differential doping of this invention within the concentration ranges shown in table 1 can be used in two-piece cathode or in one-piece cathodes as well. In the case of two-piece cathode, the cathode design is as described on FIG. 2 and in the case of a one-piece cathode, the cathode design is as described on FIG. 3.

Instead of a bimetal, a monolayer substrate with progressive differential doping can be used without departing from the invention. In the case of a two-piece cathode, the cathode design would therefore be as described on FIG. 1.

TABLE 1

| | concentration range of doping elements within cathode substrate | | | | | | |
|---|---|---|---|---|---|---|---|
| Cathode | Top layer/face | | | Bottom layer/face | | Substrate | |
| Type | W | Mg | Si | Mg | Si | E μm | Comment |
| two-piece monolayer 1 (FIG. 1) | "0%" <0.008% | 0.01%–0.1% | 0.01%–0.5% | =Top face | =Top face | 150–200 μm | Ni based monolayer constant Mg & Si % through thickness |
| two-piece monolayer 2 (FIG. 1) | 1–10.5% | 0.01–0.1% | 0.01–0.5% | =Top face | =Top face | 70–200 μm | Ni alloy monolayer constant Mg & Si % through thickness |
| two-piece double layer (FIG. 2) | 0–4% | 0.015–0.06% | 0.015–0.06% | <0.02% | <0.02% | 70–150 μm | Ni—Cr as bottom layer Ni(W) as top layer |
| one-piece double layer (FIG. 3) | 1–4% | 0.015–0.04% | 0.015–0.06% | <0.02% | <0.02% | 70–150 μm | Ni—Cr as bottom layer Ni(+W) as top layer |
| Invention Embod. 1 "Si based" | <0.008% | 0.005–0.02% | 0.01–0.025% | <0.004% | >0.06 <0.2% | 70–100 μm | Ni—Cr as bottom layer Ni as top layer |
| Invention Embod. 2 "Al instead of Si" | <0.008% | 0.005–0.02% | <0.005% but Al: 0.01–0.025% | <0.003% | <0.005% but Al: >0.06 <0.2% | 70–100 μm | Ni—Cr as bottom layer Ni as top layer |
| Invention Embod. 3 "Si based" | <0.008% | 0.05–0.1% | 0.01–0.025% | <0.004% | >0.06 <0.2% | 70–100 μm | Ni—Cr as bottom layer Ni as top layer |
| Invention Embod. 4 "Si based" | 1–3% | 0.05–0.1% | 0.01–0.025% | <0.004% | >0.06 <0.2% | 70–100 μm | Ni—Cr as bottom layer Ni as top layer |

The invention claimed is:

1. An oxide cathode for an electron gun comprising a cathodo-emissive layer basically made of alkaline earth oxides or of a mixture of such oxides, a metallic substrate having a top face onto which the cathodo-emissive layer is deposited, and a bottom face opposite to said top face, containing a plurality of reducing agents which are able to reduce said oxides under conditions of operation of said electron gun, said plurality including a first reducing agent Mg and a second reducing agent Si or Al, wherein:

on the said top face, the Mg weight concentration is superior to 0.005%, the second reducing agent weight concentration is inferior or equal to 0.025%, and the refractory metals weight concentration is inferior or equal to 3%, where so-called refractory metals are selected from the group consisting of W, Mo, Re, on the said bottom face, the Mg weight concentration is inferior to the Mg weight concentration on the said top face, and the second reducing agent weight concentration is superior to the second reducing agent weight concentration on the said top face and superior to 0.02%, the thickness E of the said metallic substrate is inferior or equal to 100 μm.

2. An oxide cathode according to claim 1 wherein:

from the said top face up to a top depth of at least 20 μm into said substrate, the Mg weight concentration related to this top face is superior to 0.005%, the second reducing agent weight concentration related to this top face is inferior or equal to 0.025%, and the refractory metals weight concentration related to this top face is inferior or equal to 3%, from the said bottom face up to a bottom depth of at least 10 μm into said substrate, the Mg weight concentration related to this bottom face is inferior to the said Mg weight concentration related to the top face, and the second reducing agent weight concentration related to this bottom face is superior to the said second reducing agent weight concentration related to the top face and is superior to 0.02%.

3. An oxide cathode according to claim 1, wherein the Mg weight concentration related to the bottom face is inferior or equal to 0.004%.

4. An oxide cathode according to claim 1, wherein the second reducing agent weight concentration related to the top face is superior to 0.01%.

5. An oxide cathode according to claim 1, wherein the second reducing agent weight concentration related to the bottom face is superior to 0.05%.

6. An oxide cathode according to claim 1, wherein the second reducing agent weight concentration related to the bottom face is inferior to 0.2%.

7. An oxide cathode according to claim 1, wherein, from the said bottom face up to a depth of at 15 μm into said substrate, the Cr weight concentration is superior or equal to 12%.

8. An oxide cathode according to claim 2, wherein the said substrate comprises two superimposed bonded metallic layers: a top layer and a bottom layer.

9. An oxide cathode according to claim 8, wherein the said bottom layer is made of nichrome.

10. An oxide cathode according to claim 1, wherein alkaline earth oxides are selected from the group consisting of BaO, SrO and CaO or BaO, SrO.

11. An oxide cathode according to claim 1, wherein said plurality of reducing agents further includes elements which are selected from the group consisting of Cr and Zr.

12. An oxide cathode according to claim 1, wherein it is a "one-piece" cathode.

13. An oxide cathode according to claim 1, wherein it is a "two-piece" cathode.

14. Electron gun having an electron source wherein said electron source is a cathode according to claim 1.

15. Cathode-ray tube wherein it includes at least an electron gun according to claim 14.

* * * * *